US006257687B1

(12) United States Patent
Iwamura

(10) Patent No.: US 6,257,687 B1
(45) Date of Patent: Jul. 10, 2001

(54) METHOD FOR DRIVING INK JET PRINTING HEAD AND CIRCUITS OF THE SAME

(75) Inventor: Takuya Iwamura, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/569,302

(22) Filed: May 11, 2000

(30) Foreign Application Priority Data

May 18, 1999 (JP) ..... 11-137894

(51) Int. Cl.[7] ..... B41J 29/38
(52) U.S. Cl. ..... 347/10; 347/9
(58) Field of Search ..... 347/10, 9, 11

(56) References Cited

U.S. PATENT DOCUMENTS 6,092,886 * 7/2000 Hosono ..... 347/10

FOREIGN PATENT DOCUMENTS 55-17589 2/1980 (JP) ..... B41J/3/04
3-30507 4/1991 (JP) ..... B41J/3/04

* cited by examiner

*Primary Examiner*—John Barlow
*Assistant Examiner*—Alfred E Dudding
(74) *Attorney, Agent, or Firm*—Foley & Lardner

(57) ABSTRACT

A method for driving an ink jet printing head and circuits of the same are provided which are capable of forming fine ink drops in a stable manner and jetting the ink drops from each nozzle with high jetting efficiency and of thereby printing a character or an image with high quality on a printing medium.

In the method for driving the ink jet printing head, a waveform of a driving signal is generated by a first voltage changing process in which a voltage is applied to increase a content volume of a pressure generating chamber and by a second voltage changing process in which a voltage is applied to decrease the content volume of the pressure generating chamber and further a time interval between time to start the first voltage changing process and time to start the second voltage changing process is set to a length of time within a range of about three eighths to about three fourths of a natural period of a pressure wave produced in the pressure generating chamber.

20 Claims, 6 Drawing Sheets

METHOD FOR DRIVING INK JET PRINTING HEAD AND CIRCUITS OF THE SAME

BACKGROUND OF THE INVENTION

1. Field of the Invention

The present invention relates to a method for driving an ink jet printing head and circuits of the same and more particularly to the method for driving the ink jet printing head and the circuits of the same in which a character or an image is printed on a printing medium such as paper, OHP (Overhead Projector) film or a like, by driving the ink jet printing head having a nozzle and by selectively jetting, from the nozzle, fine ink drops having a uniform size adjusted to meet desired printing resolution.

2. Description of the Related Art

In a conventional ink jet printing device, a printing dot is formed on a printing medium such as paper, OHP films or a like, by feeding, at a time of printing, a driving waveform signal to a pressure generating device including a piezo-electric actuator or a like disposed at a position corresponding to a pressure generating chamber of an ink jet printing head having the nozzle to cause a content volume of the pressure generating chamber filled with ink to rapidly change for jetting one ink drop from a nozzle. The ink jet printing device of this kind is widely applied to printing equipment such as a printer, plotter, copying machine, facsimile or a like.

In such ink jet printing devices as described above, since one dot is formed and then one image is created when one ink drop comes within range on the printing medium, a size of a printed dot diameter is approximately inversely proportional to an image quality. That is, in order to meet a recently increasing requirement for providing printing of a high image quality, it is necessary to form the printing dot having smaller diameter on the printing medium. The diameter of the printing dot (hereafter referred to as a "dot diameter") required for obtaining a smooth and excellent image of high quality being free from a feeling or sense of a "grain" at an area printed at a low density is considered to be not more than 40 $\mu$m, more preferably not more than 25 $\mu$m from a view point of discriminating capability of a human eye. In general, since the dot diameter is 2 to 2.5 times larger than that of the ink drop, to obtain the dot diameter of 40 $\mu$m, the diameter of the ink drop has to be about 20 $\mu$m. In this case, a total diameter of whole ink drops obtained by adding a volume of a main ink drop to that of a satellite ink which is a small ink drop formed secondarily at the rear of the main ink drop when being jetted from the nozzle is about 25 $\mu$m.

On the other hand, it is known from experiments that a minimum value of a total diameter of whole ink drops jetted from the nozzle having a predetermined aperture diameter is almost equal to a diameter of the aperture itself (a diameter of the nozzle). Therefore, to obtain a total diameter of the ink drops being 25 $\mu$m, the diameter of the nozzle must be not more than 25 $\mu$m. It is, however, impossible to produce the nozzle that can be practically used having its diameter being not more than 25 $\mu$m, without many difficulties. That is, the probability of occurrence of clogging in the nozzle increases, causing reliability and durability of the ink jet printing head to be very impaired. Because of this, a present lower limit of the nozzle diameter is about 25 to 30 $\mu$m. Accordingly, in the conventional ink jet printing device, it is difficult to jet, in a stable manner, the ink drop having its diameter of not more than 25 $\mu$m. Additionally, the conventional ink jet printing device has another problem in that, if the nozzle is designed to have its smaller diameter by simply aiming at making the ink drop finer, the ink drop having a maximum diameter of the whole ink drops enough to satisfy desired resolution cannot be jetted.

In an attempt to solve these problems, a method for driving the ink jet printing head is disclosed in, for example, Japanese Patent Application Laid-Open No. Sho55-17589, in which an ink drop being smaller in size than a nozzle diameter can be jetted by feeding an inverse trapezoidal driving waveform signal to a piezo-electric actuator to cause so-called "meniscus control" to be made immediately before jetting of the ink drop. In the method disclosed above, as shown in FIG. 8A, when jetting of the ink drop is not required, a meniscus 1 is positioned fitly at an aperture face 2*a* of a nozzle 2. When jetting of the ink drop is required, as shown in FIG. 8B, the meniscus 1 is retracted backward, from the position of the aperture face 2*a* of the nozzle 2 into an internal portion of the nozzle 2, by a driving waveform signal fed to the piezo-electric actuator, causing a content volume of a pressure generating chamber to be increased and, as a result, a shape of the meniscus becomes concave (this is called a "process of retraction"). Then, when the driving waveform signal causing the content volume of the pressure generating chamber to be decreased is fed to the piezo-electric actuator, as shown in FIG. 8C, an ink drop 3 is jetted (this is called a "process of pushing").

Moreover, another ink jet printing device is disclosed in Japanese Patent Publication No. Hei3-30507, in which a diameter of an ink drop jetted from a nozzle is changed by a variation in an amount of retracting movement (showing a "strength of retraction") of a meniscus 1 in the nozzle, occurring immediately before the jetting of the ink drop, or by a variation in timing of the retracting movement of the meniscus in the nozzle, occurring immediately before the jetting of the ink drop, which is caused by changes in a waveform of a driving waveform signal.

In the conventional method for driving the ink jet printing head or in the conventional ink jet printing device described above, since jetting characteristics including the diameter of the ink drop or a falling speed of the ink drop from the nozzle or a like are changed depending on the amount of the retraction of the meniscus in the nozzle occurring immediately before the jetting of the ink drop, the change in the diameter of the ink drop is more responsive to dispersion in dimensions of parts or external perturbations, compared with a case where the ink drop is jetted without the meniscus control.

Also, in the conventional method for driving the ink jet printing head or in the conventional ink jet printing device described above, the meniscus is retracted and the ink drop is jetted when the driving waveform signal is fed to the piezo-electric actuator to cause the content volume of the pressure generating chamber to be increased or decreased. However, the piezo-electric actuator responds not faithfully to an applied driving waveform signal but it responds to the signal, to some extent, in a vibrating manner. Since the content volume of the pressure generating chamber is changed whenever the piezo-electric actuator is vibrated, the meniscus 1 makes a reciprocating movement in the nozzle immediately before the jetting of the ink drop, as described in the above Japanese Patent Publication No. Hei03-30507. Due to adverse effects caused by a jetting history, crosstalk, use environments or a like, the retracting amount of the meniscus in the nozzle cannot be constant, even if the meniscus is retracted in a same nozzle and, as a result, the total diameter of the ink drop is changed. Therefore, the conventional method for driving the ink jet printing head and the ink jet printing device have problems in that the ink drop having a desired small diameter is not jetted successfully, a formation of the ink drop becomes very unstable and a failure in jetting the ink drop occurs.

SUMMARY OF THE INVENTION

In view of the above, it is an object of the present invention to provide a method for driving an ink jet printing head and circuits of same, being capable of reducing adverse effects caused by dispersion in dimensions of parts such as a nozzle diameter, external perturbations, jetting history of ink drops, crosstalk, use environments or a like, of forming, in a stable manner, fine ink drops while maintaining a high jetting efficiency and then jetting the ink drops from a nozzle and of printing a character or an image of high quality on a printing medium.

According to a first aspect of the present invention, there is provided a method for driving an ink jet printing head provided with a pressure generating chamber filled with ink, a pressure generator for generating a pressure in the pressure generating chamber and a nozzle being communicated with the pressure generating chamber, the method including the steps of:

feeding a driving waveform signal to the pressure generator to change a content volume of the pressure generating chamber and then to jet ink drops from the nozzle;

forming the driving waveform signal by a first voltage changing process in which a voltage is applied to increase the content volume of the pressure generating chamber and by a second voltage changing process in which a voltage is applied to decrease the content volume of the pressure generating chamber; and setting a time interval between time to start the first voltage changing process and time to start the second voltage changing process to a length of time being within a range of about three eighths to about three fourths of a natural period of a pressure wave produced in the pressure generating chamber.

In the foregoing, a preferable mode is one wherein the time interval between time to start the first voltage changing process and time to start the second voltage changing process to form the waveform of the driving waveform signal is set to a length of time being about one half of the natural period.

Also, a preferable mode is one wherein a first voltage holding process to hold, for a while, a voltage applied by the first voltage changing process is included between the first voltage changing process and the second voltage changing process to form the waveform of the driving waveform signal.

Also, a preferable mode is one wherein a second voltage holding process to hold, for a while, a voltage applied by the second voltage changing process and a third voltage changing process in which a voltage is applied to increase the content volume of the pressure generating chamber are included subsequent to the second voltage changing process to form the waveform of the driving waveform signal.

Also, a preferable mode is one wherein a voltage occurring at a time to start the first voltage changing process conforms to that occurring at a time to terminate the third voltage changing process.

Also, a preferable mode is one wherein a voltage occurring at the time to start the first voltage changing process is made different from that occurring at the time to terminate the third voltage changing process.

Also, a preferable mode is one wherein the pressure generator includes an electric-to-mechanical converting device, a magnetostrictive device or an electric-to-thermal converting device.

Furthermore, a preferable mode is one wherein the electric-to-mechanical converting device is a piezo-electric actuator.

According to a second aspect of the present invention, there is provided a driving circuit of an ink jet printing head provided with a pressure generating chamber filled with ink, a pressure generator for generating a pressure in the pressure generating chamber and a nozzle being communicated with the pressure generating chamber for changing a content volume of the pressure generating chamber to jet ink drops from the nozzle, the driving circuit including:

a waveform producing means (circuit) for producing a driving waveform signal having a waveform which is formed by a first voltage changing process in which a voltage is applied to increase a content volume of the pressure generating chamber and by a second voltage changing process in which a voltage is applied to decrease the content volume of the pressure generating chamber and which is formed by setting a time interval between time to start the first voltage changing process and time to start the second voltage changing process to a length of time being within a range about three eighths to about three fourths of a natural period of a pressure wave produced in the pressure generating chamber.

In the foregoing, it is preferable that the waveform producing means is operated to produce a driving waveform signal having a waveform which is formed by setting a time interval between the time to start the first voltage changing process and the time to start the second voltage changing process to a length of time being about one half of said natural period.

Also, it is preferable that the waveform producing means is operated to produce a driving waveform signal having a waveform which is formed by a first voltage holding process to hold, for a while, a voltage applied by the first voltage changing process included between the first voltage changing process and the second voltage changing process.

Also, it is preferable that the waveform producing means is operated to produce a driving waveform signal having a waveform which is formed by a second voltage holding process to hold, for a while, a voltage applied by the second voltage changing process and a third voltage changing process in which a voltage is applied to increase a content volume of the pressure generating chamber included subsequent to the second voltage changing process.

Also, it is preferable that the waveform producing means is operated to produce a driving waveform signal having a waveform which is formed by making a voltage occurring at a time to start the first voltage changing process conformed to that occurring at a time to terminate the third voltage changing process.

Also, it is preferable that the waveform producing means is operated to produce a driving waveform signal having a waveform which is formed by making a voltage occurring at the time to start the first voltage changing process different from that occurring at the time to terminate the third voltage changing process.

Also, it is preferable that the pressure generator includes an electric-to-mechanical converting device, a magnetostrictive device or an electric-to-thermal converting device.

Furthermore, it is preferable that the electric-to-mechanical converting device is a piezo-electric actuator.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
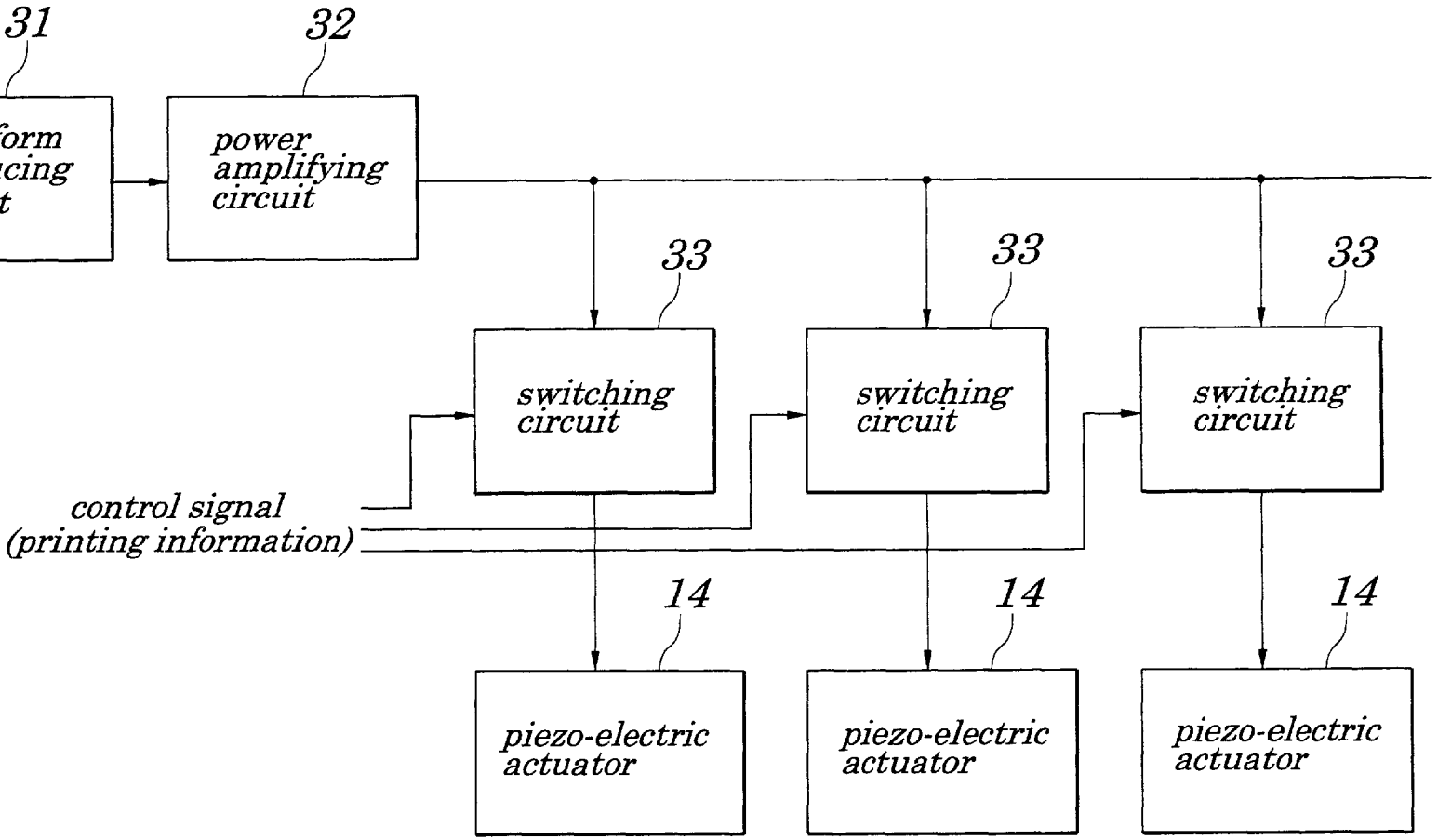
FIG. 1 is a schematic block diagram roughly showing electrical configurations of a driving circuit of an ink jet printing head employing a method for driving the ink jet printing head according to a first embodiment of the present invention.
Figure 2:
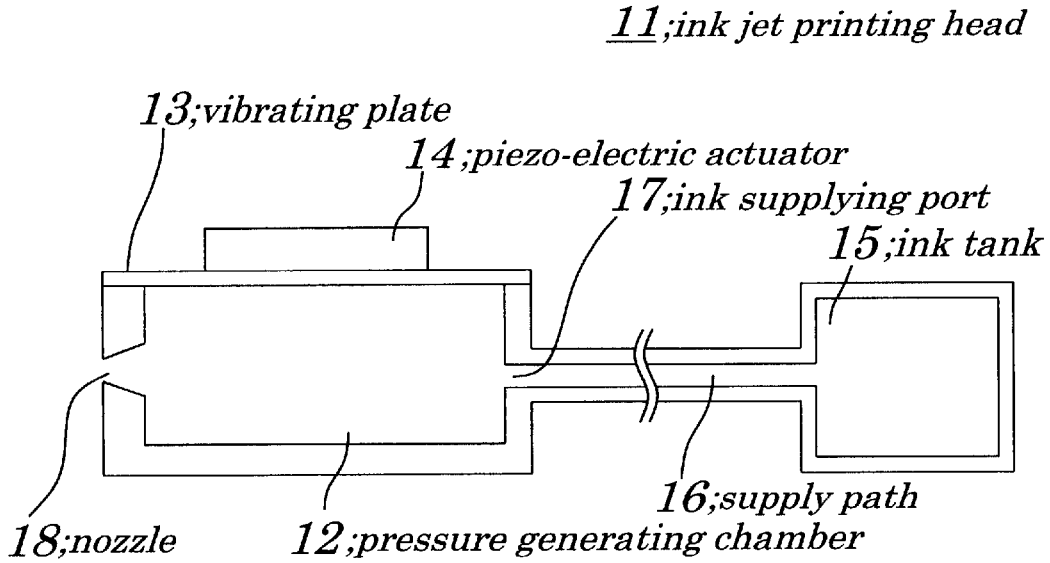
FIG. 2 is a cross-sectional view of one example of configurations of the ink jet printing head driven by the driving circuit according to the first embodiment of the present invention.
Figure 3:
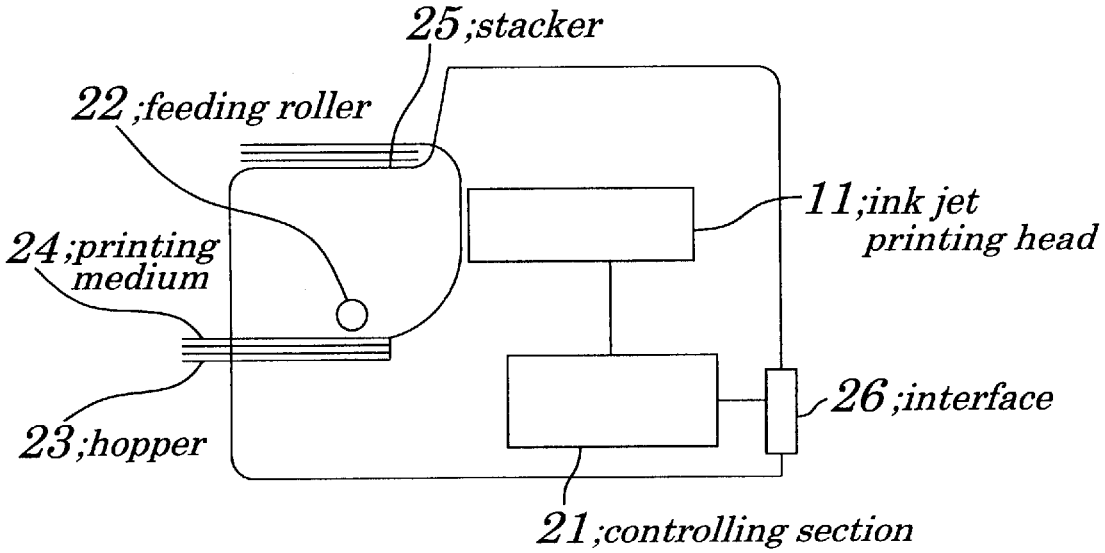
FIG. 3 is a schematic block diagram showing mechanical configurations of a printer having the driving circuit of the ink jet printing head according to the first embodiment of the present invention.

FIG. 1 is a schematic block diagram roughly showing electrical configurations of a driving circuit of an ink jet printing head employing a method for driving the ink jet printing head according to a first embodiment. FIG. 2 is a cross-sectional view of one example of configurations of the ink jet printing head driven by the driving circuit according to the first embodiment. FIG. 3 is a schematic block diagram showing mechanical configurations of a printer having the driving circuit of the ink jet printing head according to the first embodiment.

An ink jet printing head 11 of this embodiment is a Kyser-type head which is one of drop-on-demand type multi-heads designed to jet ink drops as necessary and to print a character or an image on a printing medium. The ink jet printing head 11 is chiefly composed of two or more pressure generating chambers 12 fabricated to be slender and cubical in shape as shown in FIG. 2, a vibrating plate 13 constituting an upper plate of each of the pressure generating chambers 12, a piezo-electric actuator 14 made of a laminated-type piezo-electric ceramic mounted on each of the pressure generating chambers 12, a supply path 16 connected to each of the pressure generating chambers 12, an ink supplying port 17 mounted to each of the pressure generating chambers adapted to communicate an ink tank 15 with each of the pressure generating chambers 12 through an ink pool (not shown), a nozzle 18 adapted to jet ink drops from an end portion extruding on one side of each of the pressure generating chambers 12. The nozzle 18 is formed so as to have a taper-like shape in which its diameter gradually increases toward the pressure generating chamber 12.

The ink head printing head 11 having configurations described above is mounted on a carrier (not shown) in a printer of this embodiment as shown in FIG. 3. The ink head printing head 11 is moved by a head driving motor (not shown) controlled by a controlling section 21 in order to scan a printing medium 24 conveyed from a hopper 23 by a feeding roller 22 in a direction orthogonal to a direction in which the printing medium 24 is carried. The feeding roller 22 is driven by a feeding motor (not shown) controlled by the controlling section 21. The printing medium 24 composed of paper, OHP films or a like is ejected to a stacker 25 after a character or an image is printed by the ink jet printing head 11. The controlling section 21 is provided with not-shown CPU (Central Processing Unit), ROM (Read Only Memory), RAM (Random Access Memory), or a like. The CPU is adapted, in order to print the character or the image on the printing medium 24, to control components of the printer including the head driving motor, feeding motor or the like, by executing programs stored in the ROM and using various registers or flags stored in the RAM based on printing information fed from a host computer such as a personal computer through an interface 26.

Next, electrical configurations of the driving circuit adapted to drive the ink jet printing head 11 having such configurations as described above, constituting the controlling section 21 of the printer of this embodiment, will be described below. The driving circuit shown in FIG. 1 is operated to produce a driving waveform signal corresponding to an amplified driving waveform signal shown in FIG. 4, to amplify its power and then to feed the signal to one of the piezo-electric actuators which is predetermined corresponding to printing information so as to jet ink drops each having always almost the same diameter and to print the character or image on the printing medium. The driving circuit is chiefly composed of a waveform producing circuit 31, a power amplifying circuit 32, two or more piezo-electric actuators 14 and two or more switching circuits 33 each being connected to each of the piezo-electric actuators 14.

Figure 4:
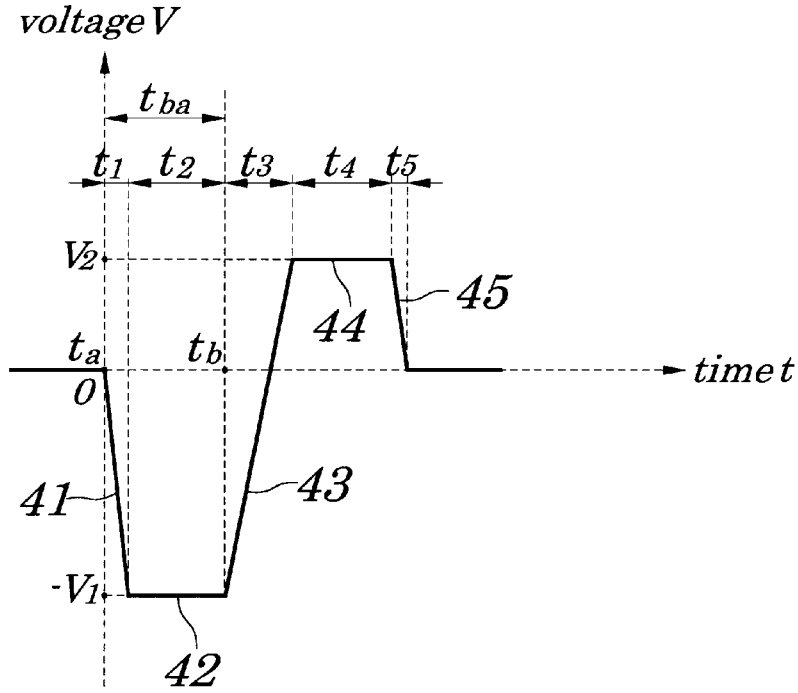
FIG. 4 is a diagram showing one example of a waveform profile of an amplified driving waveform signal fed from a power amplifying circuit constituting the driving circuit of the ink jet printing head according to the first embodiment of the present invention.

The waveform producing circuit 31 composed of a digital-to-analog converter and an integration circuit is operated to convert a driving waveform data read out from a predetermined memory area in the ROM to analog data, to make an integration treatment by the CPU and then to produce a driving waveform signal corresponding to the amplified driving waveform signal shown in FIG. 4. The power amplifying circuit 32 is operated to amplify a power of the driving waveform signal fed from the waveform producing circuit 31 and to output the signal as the amplified driving waveform signal shown in FIG. 4. An input terminal of the switching circuit 33 is connected to an output terminal of the power amplifying circuit 32 and its output terminal is connected to one terminal of the corresponding piezo-electric actuator 14. When a control signal corresponding to printing information to be outputted from a driving control circuit (not shown) is inputted to a control terminal of the switching circuit, the switching circuit is switched ON and is operated to feed an amplified driving waveform signal to be outputted from the power amplifying circuit 32 to the piezo-electric actuator 14. This causes the piezo-electric actuator 14 to provide a displacement corresponding to the amplified driving waveform signal to the vibrating plate 13. Since a content volume of the pressure generating chamber 12 is changed rapidly by the displacement of the vibrating plate 13 provided by the piezo-electric actuator 14, a predetermined pressure wave is produced in the pressure generating chamber 12 filled with ink, which then causes the ink drop having a predetermined diameter to be jetted from the corresponding nozzle 18. The jetted ink drop falls on the printing medium 24 and forms a printing dot. By repeating the formation of the printing dot in accordance with the printing information, the character or image is printed on the printing medium.

As depicted in FIG. 4, the amplified driving waveform signal described above is generated by a first voltage changing process 41 (called a "retracting process") in which the voltage V applied to the piezo-electric actuator 14 is decreased (from 0 volts to $-V_1$) to cause the content volume of the pressure generating chamber 12 to be increased for retracting a meniscus, then by a first voltage holding process 42 in which the decreased voltage V is held (from $-V_1$ to $-V_1$) for a while (for a time $t_2$), by a second voltage changing process 43 (called a "pushing process") in which the applied voltage V is increased ($-V_1$ to $V_2$) in order to decrease the content volume of the pressure generating chamber 12 for jetting the ink drop, by a second voltage holding process 44 in which the increased voltage V is held (from $V_2$ to $V_2$) for a while (for a time $t_4$) and by a third voltage changing process 45 in which the applied voltage is decreased to cause the content volume of the pressure generating chamber 12 to be again increased. In the processes for generating the amplified driving waveform signal described above, a time interval $t_{ba}$ ($=t_b-t_a=t_1+t_2$) between time $t_a$ (=0) to start the process for retracting the meniscus inward and time $t_b$ to start the process for pushing the meniscus outward is set to a length of time being approximately one half of a natural period $T_c$ of a pressure wave produced in the pressure generating chamber 12 filled with ink. In this example, the natural period $T_c$ is 10 $\mu$s to 20 $\mu$s, however, it may be not more than 10 $\mu$s or not less than 20 $\mu$s.

Next, a reason why a waveform profile of the amplified driving waveform signal is such as shown in FIG. 4 will be described.

Figure 5:
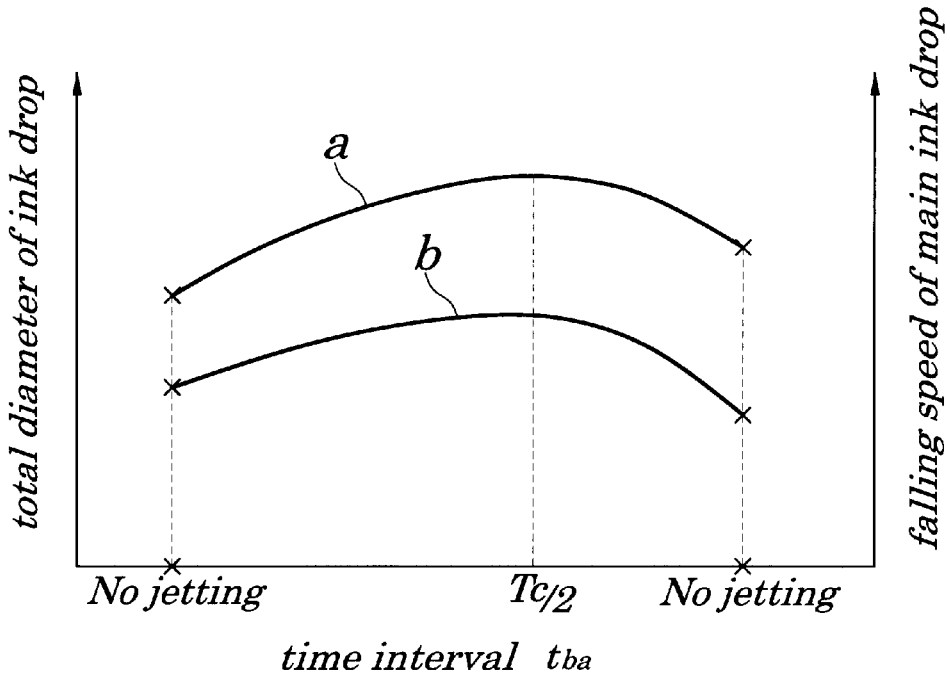
FIG. 5 is a diagram showing one example of results obtained by simulations on characteristics of changes in a total diameter of ink drops and a falling speed of a main ink drop versus a time interval in a state where an applied voltage of an amplified driving waveform signal is constant.

First, the inventor of the present invention has made a fluid analysis model on phenomena of jetting the ink drop from the ink jet printing head and performed a simulation on a relationship between the waveform profile of the amplified driving waveform signal and the jetting characteristics (including the diameter of the drop and the falling speed of the drop) of the ink drops. The simulation result shows that such changes in the total diameter of an ink drop and in the falling speed of a main ink drop as shown in FIG. 5 occur against the time interval $t_{ba}$ between time $t_a$ to start the process of retracting the meniscus inward and time $t_b$ to start the process of pushing the meniscus outward in a state where the applied voltage V of the amplified driving waveform signal is maintained constant. In FIG. 5, a curved line "a" shows characteristics of changes in the total diameter of the ink drop versus the time interval $t_{ba}$, while a curved line "b" shows characteristics of changes in the falling speed of the ink drop versus the time interval $t_{ba}$. As is apparent from FIG. 5, both the curves "a" and "b" are convex in shape and their maximum peaks are at a point where the time interval $t_{ba}$ is set to a length of time being approximately one half of the natural period $T_c$. This indicates that a reaction caused by the pressure wave produced in the pressure generating chamber 12 by the addition of the retraction process to the meniscus control is exerting an influence on the jetting characteristic. It is understood, therefore, that point, where the time interval is set to a length of time being approximately one half of the natural period $T_c$ and where a phase of the pressure wave produced by the "retraction" process conforms to that of the pressure wave produced by the "pushing" process, is a point for providing best jetting efficiency of the ink drop.

Figure 6:
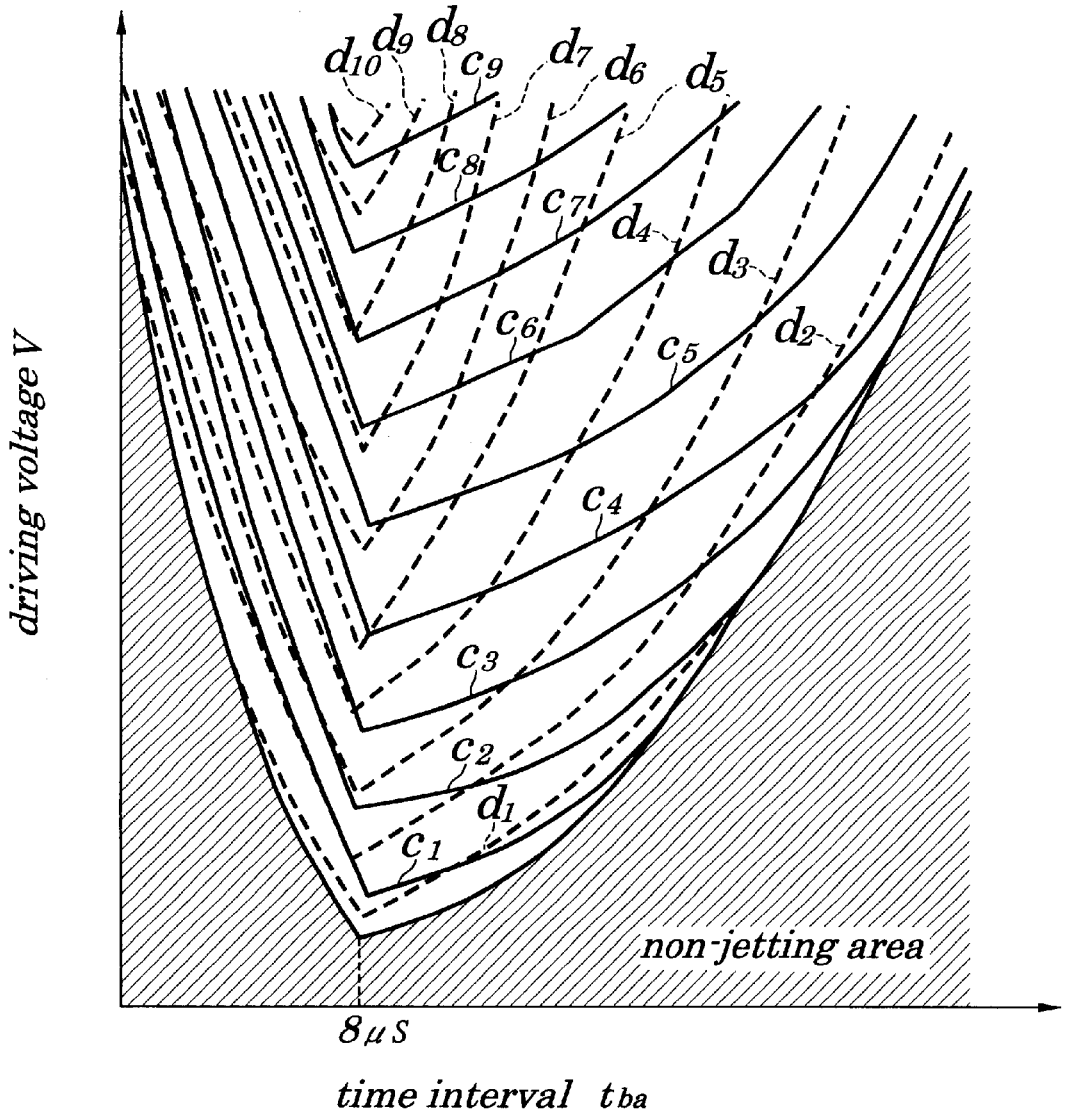
FIG. 6 is a diagram showing one example of results obtained by actually measuring characteristics of changes in the total diameter of ink drops and the falling speed of the main ink drop versus the applied voltage of the amplified driving waveform signal and time interval.

Moreover, the inventor of the present invention has done experimental research about influences of the waveform profile of the amplified driving waveform signal on jetting characteristics of the ink drop including the diameter or the falling speed of the ink drop. The results show that changes in the jetting characteristics of the ink drop occur against the applied voltage V of the amplified driving waveform signal and the time interval $t_{ba}$ as seen in FIG. 6. Curved lines $c_1$ to $c_9$ drawn in a solid line in FIG. 6 are lines showing characteristics of changes in the applied voltage V versus the time interval $t_{ba}$ when the total diameter of the ink drop is 16, 18, . . . , 32 $\mu$m (in steps of 2 $\mu$m), while curved lines $d_1$ to $d_9$ drawn in a broken line are lines showing characteristics of changes in the applied voltage V versus the time interval $t_{ba}$ when the falling speed of the main ink drop is 2, 3, . . . , 11 m/s (in steps of 1 m/s). In this example, since natural period $T_c$ of the pressure wave produced in the pressure generating chamber 12 constituting the employed ink jet printing head 11 is about 16 $\mu$s, the length of time being about one half of the natural period $T_c$ becomes about 8 $\mu$s as shown in FIG. 6. Moreover, an area indicated by sloped lines in FIG. 6 shows that the ink drop is not jetted from the nozzle if a condition for driving the ink jet printing head is at any point in the above area (non-jetting area). As shown in FIG. 6, any point forming a valley on each of the curved lines $c_1$ to $c_9$ and $d_1$ to $d_{10}$ is at a point where the time interval $t_{ba}$ is about 8 $\mu$s, which is also a point where the time interval is set to a length of time being approximately one half of the natural period $T_c$. Moreover, in FIG. 6, when the driving voltage V is fixed to a certain level of the voltage, when any of the curved lines $c_1$ to $c_9$ and $d_1$ to $d_{10}$ is cut at a certain point along an axis of abscissa in a horizontal direction, the total diameter of the ink drop and the falling speed of the main ink drop represented respectively by the above curved lines increase and decrease with the point where the time interval is set to a length of time being approximately one half of the natural period $T_c$ being their maximum or with the above point being their minimum. That is, since an almost same tendency was shown in FIGS. 5 and 6, the above simulation is confirmed to be appropriate.

Thus, at the point forming a valley on each of the curved lines $c_1$ to $c_9$ and $d_1$ to $d_{10}$, the ink drop having the same total diameter can be jetted at a faster falling speed of the ink drop and the applied voltage of the amplified driving waveform signal can be at the minimum level, indicating that this point is a point where the best jetting efficiency is provided.

However, though the falling speed of the main ink drop even having the same diameter becomes more faster if the time interval is further shorter than the length of time being approximately one half of the natural period $T_c$, as shown in FIG. 6, it causes the interval between the curved lines $c_1$ to $c_9$ each being neighboring and between the curved lines $d_1$ to $d_{10}$ each being neighboring to become extremely dense and, as a result, operations tend to be easily affected by external perturbations, possibly making it difficult to jet ink drop in a stable manner.

Thus, when the waveform profile of the amplified driving waveform signal is set, since it is necessary to take into consideration a stability in jetting the ink drop, jetting characteristics of the ink drop (including the diameter and falling speed of the ink drop), a phase lag (about 0 to 2 μs) of the pressure wave caused by a structure of the pressure generating chamber or by an inherent ink property, it is desirous to set the time interval $t_{ba}$ within a range designated by the following formula (1):

$$3T_c/8 \leq t_{ba} \leq 3T_c/4 \quad (1)$$

In the formula (1), a lower limit is set when the fine ink drop should be jetted by giving a top priority to characteristics of jetting the ink even at an expense of stability in jetting the ink drop, while an upper limit is set when the phase lag of the pressure wave should be avoided. This enables both the efficiency in jetting the ink drop and stability in jetting to be reconciled.

Second Embodiment

Figure 7:
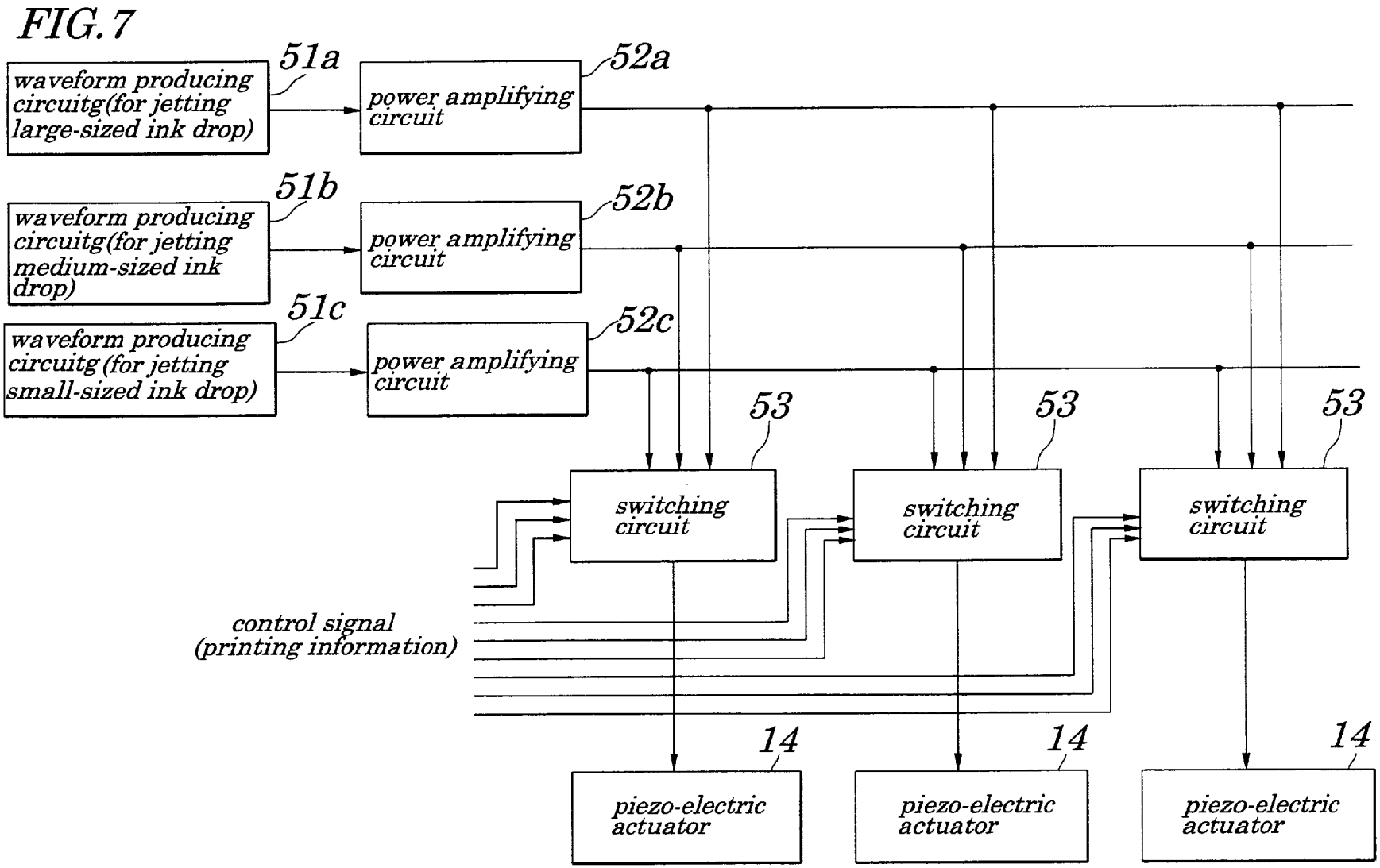
FIG. 7 is a schematic block diagram roughly showing electrical configurations of a driving circuit of an ink jet printing head employing a method for driving the ink jet printing head according to a second embodiment of the present invention.
Figure 8A:
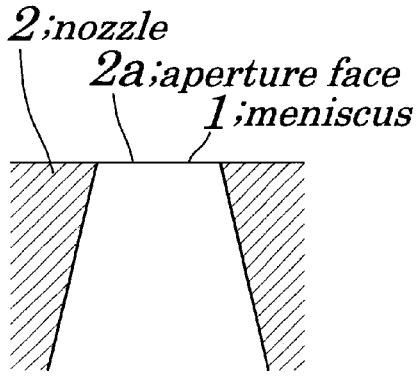
FIG. 8A(PRIOR ART)
FIGS. 8A, 8B and 8C are cross-sectional views of an aperture face of a nozzle and its related portion provided to explain a process of jetting an ink drop in a conventional method for driving the ink jet printing head.
Figure 8B:
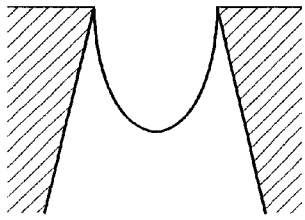
FIG. 8B(PRIOR ART)
Figure 8C:
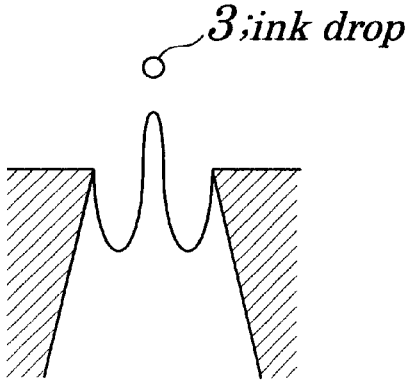
FIG. 8C(PRIOR ART)

FIG. 7 is a schematic block diagram roughly showing electrical configurations of a driving circuit of an ink jet printing head employing a method for driving the ink jet printing head of a second embodiment of the present invention. Since mechanical configurations of a printer on which above driving circuit is mounted and configurations of the ink jet printing head driven by the driving circuit are same as those explained in the first embodiment (see FIGS. 2 and 3), their descriptions will be omitted.

The driving circuit shown in FIG. 7 is a so-called ink-drop diameter dividing type driving circuit in which a diameter of an ink drop jetted from the nozzle is divided into multiple sizes of the ink drop (in this example, into three levels including a large-sized ink drop with a diameter of about 40 μm, a medium-sized ink drop with a diameter of about 30 μm and a small-sized ink drop with a diameter of about 20 μm) based on printing information represented by gradations and then a character or an image is printed with multiple-gradations, being chiefly composed of three kinds of waveform producing circuits 51*a*, 51*b* and 51*c* designed in accordance with the diameter of the ink drop, power amplifying circuits 52*a*, 52*b* and 52*c*, each being connected to each of the waveform producing circuits in a one-to-one relationship, a plurality of piezo-electric actuators 14 and a plurality of switching circuits 53 each being connected to each of piezo-electric actuators 14 in a one-to-one relationship.

Each of the waveform producing circuits 51*a* to 51*c* is composed of an analog-to-digital converting circuit and an integration circuit. The waveform producing circuit 51*a* is operated, after converting driving waveform data for jetting the large-sized ink drop read by a CPU from a predetermined storage area of a ROM to its analog data and making a treatment by integration, to produce a driving waveform signal for jetting the large-sized ink drop. The waveform producing circuit 51*b* is operated, after converting driving waveform data for jetting the medium-sized ink drop read by the CPU from a predetermined storage area of the ROM to its analog data and making a treatment by integration, to produce a driving waveform signal for jetting the medium-sized ink drop. The waveform producing circuit 51*c* is operated, after converting driving waveform data for jetting the small-sized ink drop read by the CPU from a predetermined storage area of the ROM to its analog data and making a treatment by integration, to produce a driving waveform signal for jetting the small-sized ink drop.

The power amplifying circuit 52*a* is operated to power-amplify the driving waveform signal for jetting the large-sized ink drop supplied from the waveform producing circuit 51*a* and to output it as an amplified driving waveform signal for jetting the large-sized ink drop. The power amplifying circuit 52*b* is operated to power-amplify the driving waveform signal for jetting the medium-sized ink drop supplied from the waveform producing circuit 51*b* and to output it as an amplified driving waveform signal for jetting the medium-sized ink drop.

The power amplifying circuit 52*c* is operated to power-amplify the driving waveform signal for jetting the small-sized ink drop fed from the waveform producing circuit 51*c* and to output it as an amplified driving waveform signal for jetting the small-sized ink drop. The switching circuits 53 are composed of first, second and third transfer gates (not shown). An input terminal of the first transfer gate is connected to an output terminal of the power amplifying circuit 52*a*. An input terminal of the second transfer gate is connected to an output terminal of the power amplifying circuit 52*b*. An input terminal of the third transfer gate is connected to an output terminal of the power amplifying circuit 52*c*. Output terminals of the first, second and third transfer gates are connected to one terminal of the corresponding common piezo-electric actuator 14. When a gradation controlling signal corresponding to printing information fed from a driving control circuit (not shown) is inputted to a control terminal of the first transfer gate, the first transfer gate is turned ON, causing the amplified driving waveform signal for jetting the large-sized ink jet fed from the power amplifying circuit 52*a* to be applied to the piezo-electric actuator 14. This causes the piezo-electric actuator 14 to provide a displacement corresponding to the amplified driving waveform signal to be applied to a vibrating plate 13. By rapidly changing (increasing or decreasing) the content volume of the pressure generating chamber using this displacement of the vibrating plate 13, a predetermined pressure wave is produced in a pressure generating chamber 12 filled with ink. The produced pressure wave causes the large-sized ink drop to be jetted from a nozzle 18.

On the other hand, when a gradation control signal corresponding to printing information fed from the driving control circuit is inputted to a control terminal of the second transfer gate, the second transfer gate is turned ON, causing the amplified waveform signal for jetting the medium-sized ink drop fed from the power amplifying circuit 52*b* to be applied to the piezo-electric actuator 14. This causes the piezo-electric actuator 14 to provide the displacement corresponding to the amplified driving waveform signal to be applied to the vibrating plate 13. By changing the content volume of the pressure generating chamber 12 using this displacement of the vibrating plate 13, the predetermined pressure wave is produced in the pressure generating chamber 12 filled with ink. The produced pressure wave causes the medium-sized ink drop to be jetted from the nozzle 18.

Moreover, when a gradation control signal corresponding to printing information fed from the driving control circuit is inputted to a control terminal of the third transfer gate, the third transfer gate is turned ON, causing the amplified waveform signal for jetting the small-sized ink drop fed from the power amplifying circuit 52*c* to be applied to the piezo-electric actuator 14. This causes the piezo-electric actuator 14 to provide the displacement corresponding to the amplified driving waveform signal to be applied to the vibrating plate 13. By changing the content volume of the pressure generating chamber 12 using this displacement of the vibrating plate 13, the predetermined pressure wave is produced in the pressure generating chamber 12 filled with ink. The produced pressure wave causes the small-sized ink drop to be jetted from the nozzle 18. The jetted ink drops reach a printing medium 24 and cause printing dots to be formed. By the repeated formation of such printing dots in accordance with printing information, a character or an image is printed on the printing medium 24 with multiple gradations.

By setting the waveform profile of the amplified driving waveform signal for jetting the large-sized, medium-sized or small-sized ink drops, in accordance with the formula (1), even in printing with multiple gradations, both efficiency in jetting the ink drop and stability in jetting can be reconciled.

As described above, according to configurations of the present invention, since the waveform of the driving waveform signal is generated by the first voltage changing process in which the voltage is applied to increase the content volume of the pressure generating chamber and by the second voltage changing process in which the voltage is applied to decrease the content volume of the pressure generating chamber and further the time interval between the time to start the first voltage changing process and the time to start the second voltage changing process is set to a length of time within the range of about three eighths to about three fourths of the natural period $T_c$ of the pressure wave produced in the pressure generating chamber, adverse effects caused by dispersions in dimensions of parts including diameter of the nozzle or external perturbations, history of jetting the ink drop, crosstalk, use environments or like can be reduced and, at a same time, fine ink drops can be formed in a stable manner and be jetted from each nozzle with high jetting efficiency. This enables the character or image with high quality to be printed on the printing medium.

It is apparent that the present invention is not limited to the above embodiments but may be changed and modified without departing from the scope and spirit of the invention. For example, in the embodiments described above, the method for driving the ink jet printing head of the present invention is applied to the printer, however, it may be applied to other ink jet printing devices including a plotter, copying machine, facsimile or a like. Moreover, when the above method is applied to the facsimile, the interface 26 is connected to a communication line. If the above method is applied to the copying machine, it is necessary to use a scanner for inputting an image to be copied. In this case, there is no need to mount the interface 26.

Also, in each of the embodiments described above, the nozzle 18 is formed so as to have the taper-like shape, however, the invention is not limited to the nozzle having the taper-like shape. Similarly, the aperture of the nozzle 18 may be not only circular but also rectangular or triangular in shape. Furthermore, configurations and positions of the nozzle 18, pressure generating chamber 12, ink supplying port 17 are not limited to those described in the above embodiment. For example, the nozzle 18 may be disposed below the center portion of the pressure generating chamber 12.

Also, in each of the embodiments described above, the pressure generating chamber 12 fabricated to be slender and cubical in shape is employed, however, the pressure generating chamber 12 may have any shape.

Also, in each of the embodiments described above, the voltage at the time of starting the first voltage changing process 41 is adapted to conform to that at the time of terminating the third voltage changing process 45, however, these voltages may be different from each other. In each of the embodiments, the reference voltage is set to 0 (zero) volts, however, the reference voltage may be set arbitrarily to any value.

Also, in each of the embodiments described above, the first voltage holding process 42 and the second voltage holding process 44 are introduced to generate the amplified driving waveform signal, however, either of them or all of them may be omitted.

Moreover, in each of the embodiments described above, the Kyser-type ink jet printing head 11 is used, however, no limitation is imposed; any type of the ink jet printing head may be employed so long as it is a type of the ink jet printing head that can jet ink drops from the nozzle by changing the pressure in the pressure generating chamber using a pressure generator.

Furthermore, in each of the embodiments described above, the piezo-electric actuator made of laminated-type piezo-electric ceramic is used as the pressure generator, however, there is no limitation; any piezo-electric actuator having other configurations including an electric-to-mechanical converting device, a magnetostrictive device, or an electric-to-thermal converting device may be employed.

Finally, the present application claims the priority of Japanese Patent Application No. Hei11-137894 filed on May 18, 1999, which is herein incorporated by reference.

What is claimed is:

1. A method for driving an ink jet printing head provided with a pressure generating chamber filled with ink, a pressure generator for generating a pressure in said pressure generating chamber and a nozzle being communicated with said pressure generating chamber, said method comprising the steps of:

feeding a driving waveform signal to said pressure generator to change a content volume of said pressure generating chamber and then to jet ink drops from said nozzle;

forming said driving waveform signal by a first voltage changing process in which a voltage is applied to increase said content volume of said pressure generating chamber and by a second voltage changing process in which a voltage is applied to decrease said content volume of said pressure generating chamber; and setting a time interval between time to start said first voltage changing process and time to start said second voltage changing process to a length of time being within a range of about three eighths to about three fourths of a natural period of a pressure wave produced in said pressure generating chamber.

2. The method for driving the ink jet printing head according to claim 1, wherein said time interval between time to start said first voltage changing process and time to start said second voltage changing process to form said waveform of said driving waveform signal is set to a length of time being about one half of said natural period.

3. The method for driving the ink jet printing head according to claim 1, wherein a first voltage holding process to hold, for a while, a voltage applied by said first voltage changing process is included between said first voltage changing process and said second voltage changing process to form said waveform of said driving waveform signal.

4. The method for driving the ink jet printing head according to claim 1, wherein a second voltage holding process to hold, a voltage applied by said second voltage changing process and a third voltage changing process in which a voltage is applied to increase said content volume of said pressure generating chamber are included subsequent to said second voltage changing process to form said waveform of said driving waveform signal.

5. The method for driving the ink jet printing head according to claim 4, wherein a voltage occurring at a time to start said first voltage changing process conforms to that occurring at a time to terminate said third voltage changing process.

6. The method for driving the ink jet printing head according to claim 4, wherein a voltage occurring at the time to start said first voltage changing process is made different from that occurring at a time to terminate said third voltage changing process.

7. The method for driving the ink jet printing head according to claim 1, wherein said pressure generator includes an electric-to-mechanical converting device, a magnetostrictive device or an electric-to-thermal converting device.

8. The method for driving the ink jet printing head according to claim 7, wherein said electric-to-mechanical converting device is a piezo-electric actuator.

9. A driving circuit of an ink jet printing head provided with a pressure generating chamber filled with ink, a pressure generator for generating a pressure in said pressure generating chamber and a nozzle being communicated with said pressure generating chamber for changing a content volume of said pressure generating chamber to jet ink drops from said nozzle, said driving circuit comprising:

a waveform producing means for producing a driving waveform signal having a waveform which is formed by a first voltage changing process in which a voltage is applied to increase said content volume of said pressure generating chamber and by a second voltage changing process in which a voltage is applied to decrease said content volume of said pressure generating chamber and which is formed by setting a time interval between time to start said first voltage changing process and time to start said second voltage changing process to a length of time being within a range about three eighths to about three fourths of a natural period of a pressure wave produced in said pressure generating chamber.

10. The driving circuit of the ink jet printing head according to claim 9, wherein said waveform producing means is operated to produce a driving waveform signal having a waveform which is formed by setting a time interval between time to start said first voltage changing process and time to start said second voltage changing process to a length of time being about one half of said natural period.

11. The driving circuit of the ink jet printing head according to claim 9, wherein said waveform producing means is operated to produce a driving waveform signal having a waveform which is formed by a first voltage holding process to hold a voltage applied by a first voltage changing process included between said first voltage changing process and said second voltage changing process.

12. The driving circuit of the ink jet printing head according to claim 9, wherein said waveform producing means is operated to produce a driving waveform signal having a waveform which is formed by a second voltage holding process to hold, a voltage applied by said second voltage changing process and a third voltage changing process in which a voltage is applied to increase said content volume of said pressure generating chamber included subsequent to said second voltage changing process.

13. The driving circuit of the ink jet printing head according to claim 12, wherein said waveform producing means is operated to produce a driving waveform signal having a waveform which is formed by making a voltage occurring at a time to start said first voltage changing process conformed to that occurring at a time to terminate said third voltage changing process.

14. The driving circuit of the ink jet printing head according to claim 12, wherein said waveform producing means is operated to produce a driving waveform signal having a waveform which is formed by making a voltage occurring at a time to start said first voltage changing process different from that occurring at a time to terminate said third voltage changing process.

15. The driving circuit of the ink jet printing head according to claim 9, wherein said pressure generator includes an electric-to-mechanical converting device, a magnetostrictive device or an electric-to-thermal converting device.

16. The driving circuit of the ink jet printing head according to claim 15, wherein said electric-to-mechanical converting device is a piezo-electric actuator.

17. A driving circuit of an ink jet printing head provided with a pressure generating chamber filled with ink, a pressure generator for generating a pressure in said pressure generating chamber and a nozzle being communicated with said pressure generating chamber for changing a content volume of said pressure generating chamber to jet ink drops from said nozzle, said driving circuit comprising:

a waveform producing circuit for producing a driving waveform signal having a waveform which is formed by a first voltage changing process in which a voltage is applied to increase said content volume of said pressure generating chamber and by a second voltage changing process in which a voltage is applied to decrease said content volume of said pressure generating chamber and which is formed by setting a time interval between time to start said first voltage changing process and time to start said second voltage changing process to a length of time being within a range about three eighths to about three fourths of a natural period of a pressure wave produced in said pressure generating chamber.

18. The driving circuit of the ink jet printing head according to claim 17, wherein said waveform producing circuit is operated to produce a driving waveform signal having a waveform which is formed by setting a time interval between time to start said first voltage changing process and time to start said second voltage changing process to a length of time being about one half of said natural period.

19. The driving circuit of the ink jet printing head according to claim 17, wherein said waveform producing circuit is operated to produce a driving waveform signal having a waveform which is formed by a first voltage holding process to hold a voltage applied by a first voltage changing process included between said first voltage changing process and said second voltage changing process.

20. The driving circuit of the ink jet printing head according to claim 17, wherein said waveform producing circuit is operated to produce a driving waveform signal having a waveform which is formed by a second voltage holding process to hold a voltage applied by said second voltage changing process and a third voltage changing process in which a voltage is applied to increase said content volume of said pressure generating chamber included subsequent to said second voltage changing process.

* * * * *